United States Patent [19]

Bay

[11] Patent Number: 4,495,657

[45] Date of Patent: Jan. 29, 1985

[54] HELMET SHIELD APPARATUS

[76] Inventor: William P. Bay, Rte. 1, Box 53, Ormond Beach, Fla. 32074

[21] Appl. No.: 428,688

[22] Filed: Sep. 30, 1982

[51] Int. Cl.[3] ..... A61F 9/04; A63B 71/10

[52] U.S. Cl. ..... 2/10; 2/424; 2/425

[58] Field of Search ..... 2/10, 425, 424, 6, 8, 2/9

[56] References Cited

U.S. PATENT DOCUMENTS 4,097,930 7/1978 Bay ..... 2/10

FOREIGN PATENT DOCUMENTS 1421772 1/1976 United Kingdom ..... 2/10

1427992 3/1976 United Kingdom ..... 2/10

*Primary Examiner*—Werner H. Schroeder

*Assistant Examiner*—Judith L. Kravitz

*Attorney, Agent, or Firm*—William M. Hobby, III

[57] ABSTRACT

A snap on shield for a helmet is formed with a transparent surface of a predetermined shape to fit onto a helmet to protect the face of a wearer. The shield is injection molded of a polymer material having a molded female center snap portion for engaging a male snap portion on a helmet and a female polymer snap portion formed on each side of the shield. Each snap portion is an elongated snap portion that allows the male snap portion to be snapped in at any position along the elongated female snap portions. The helmet shield can be fitted to different helmets having male fastener portions in different positions. Each elongated polymer snap fastener portion has an elongated groove formed in the shield and has an elongated lip formed along each elongated edge of each groove and protruding over a portion of the groove. Each lip has a predetermined shape to receive a male snap fastener portion into the groove to be held in one piece to fit a large variety of helmets having variations in the positioning of the helmet snap fastener portions thereon.

11 Claims, 6 Drawing Figures

HELMET SHIELD APPARATUS

BACKGROUND OF THE INVENTION

The present invention relates to face shields and especially to motorcycle face shields for attaching to protective helmets, and the like, and especially to such a face shield adapted to fit a wide variety of helmets.

In the past, a variety of helmets have been designed for use by motorcycle riders, race car drivers, and the like, to protect the head of a user against damage in the event of an accident. The helmets typically provide a male portion of a snap fastener for attaching thereto, so that a face shield may be attached to the helmet. The face shield protects the user of a motorcycle from the wind, rain, and the like, when riding the motorcycle, and may be snapped off when not needed or desired. It may be easily replaced in the event that the face shield is damaged, inasmuch as a number of manufacturers make helmets, which manufacturers may typically make a matching face shield in which the snap fastener portions are positioned to cooperate with the snap fastener portions on the manufacturers' shield. This has presented somewhat of a problem to provide a shield that will fit all or most helmets on the market. To overcome this problem, a number of solutions have been proposed. One common technique now used for making face shields adaptable to a larger number of helmets has been to mold the face shield with T-shaped slots located over the portion to engage the ear snap fastener of the helmet and also with a vertical slot for the two outboard snap fasteners. Female snap fastening portions are then connected with studs through these slots loosely so that the fasteners can slide around in the slots to adjust the position of the snap fasteners to fit these particular helmets. This has worked satisfactory, but metal snap fasteners which use female sockets with brass or bronze rings mounted therein are expensive to purchase and to attach to the face shield, inasmuch as they require snap machines as well as employees to operate the snap machines to place the snap fasteners in place. This results in a number of rejects associated with the snap fastener machinery. In addition, the metal snap fasteners' being loosely fitted with ring snaps therein tend to rattle when wind currents or stresses are put upon the attached face shield. To overcome these problems, one manufacturer has suggested providing a shield with a series of slots in a plastic face shield which will simply snap on the male fasteners of the helmet directly through the slots to hold the face shield in the slots. This however, has proved inadequate because the snap fasteners fit the slots in the same place for each brand helmet and while satisfactory the first few times the shield is snapped upon the helmet, the shield rapidly loosens as the plastic is stretched and even hobbed by the snapping of the male snap fastener through the thin edge of plastic of the slot. One of the difficulties in matching the shield to the helmet has been the use of a center snap along with outboard snaps and ear snaps which require fairly precise lining up of all the snap fasteners. The present invention, on the other hand, eliminates the outboard snap fasteners on the face shield in favor of elongated snap fastener portions shaped to receive the male snap fastener portions in any position along an elongated grooved fastener molded with the shield. Thus, an elongated center female snap fastener portion connects directly to the male center snap fastener portion of the helmet and the shield can be pulled back into position to engage one of the elongated ear snap fasteners. This allows the manufacturer to utilize a face shield of one molded piece, to substantially reduce the cost of making the face shield which does not rattle. The female plastic fasteners thus provide a strong holding action with the metal male fastener portions on the helmet. In addition, male snap fastener portions can be molded directly to the front of the shield to shade the eyes of the user.

Frequently, shields are subjected to high wind speeds while used during racing or normal riding and it becomes advantageous to use the very tightest active snaps so as to prevent the shield from unsnapping and thereby disorienting the wearer, which may cause an accident. Since all metal female ring snaps or sockets have a ring which is not unified, they cannot be made as tight as would be possible, since to do so would mean the broken ring would have to be made so small it would be too small to stretch over the male stud portion when attempting to snap it on, and would thereby not snap on at all. It would also stretch the metal beyond its tensile limits resulting in permanent deflection. It is desirable to have a snap ring having a diameter that will work on one or several manufacturers' studs in the same general size class. A hard action socket would be totally unsatisfactory on the smallest of studs to be found (about 0.382 inches head in diameter) and very difficult to use because it would be too hard an action on the largest of studs found (about 0.398 inches-head in diameter). An important factor is that less expensive plastics of a transparent optical grade typically have a reasonable freedom from shattering, however, do not work well if manufactured as a socket and stud assembly and affixed to the shield slots such as metal snaps are used. This is because the sockets stretch and permanently deform more and more as they are continually snapped.

In the present snap, the socket's base is a part of the shield thereby preventing stretching and making it possible for a tighter action than metal ring snaps provide. The present invention is an improvement over my prior U.S. Pat. No. 4,097,930 dated July 4, 1978, for a Helmet Shield Apparatus, and provides a more attractive universal helmet shield which can fit a variety of helmets without having large variety of female snap portion and provides an attractive fit to the helmet by having the elongated groove fasteners substantially on a plane with the inside of the shield with the depth being provided to the groove from a single neat protrusion on the other side of the shield.

SUMMARY OF THE INVENTION

A helmet snap on shield is provided having a transparent shield of predetermined shape to fit onto a helmet and having two sides, a top, bottom and two end edges. A polymer center snap fastener portion is formed in the shield adjacent the top edge of the shield and a pair of polymer snap fastener portions are fored in the shield with one located adjacent each end edge of the shield. Each polymer snap fastener portion has an elongated groove having an elongated lip formed along each elongated edge of the groove and protruding over a portion of the groove. Elongated lips having a predetermined shape to receive a male snap fastener portion therein in any position along the elongated groove allows the helmet shield to be fitted to different helmets having male fastener portions in different positions.

The center fastener portion is mounted in a generally vertical direction while the ear snap fastener portions are mounted in a generally horizontal direction with their axes 90° from the axis of the center snap portion, so that the shield can be moved up and down to the proper position to line up the ear helmet snaps, which can then be positioned along the horizontal groove snap portions. The snap portions are molded into the shield and protrudes through to the other side or front of the shield and the shield may be frosted around the perimeter on three sides to improve the appearance of the protruding snap fastener portions. The male snap portions may be formed on the front of the shield for attaching a visor thereto.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figures 1, 2, 3, 4, 5, 6:
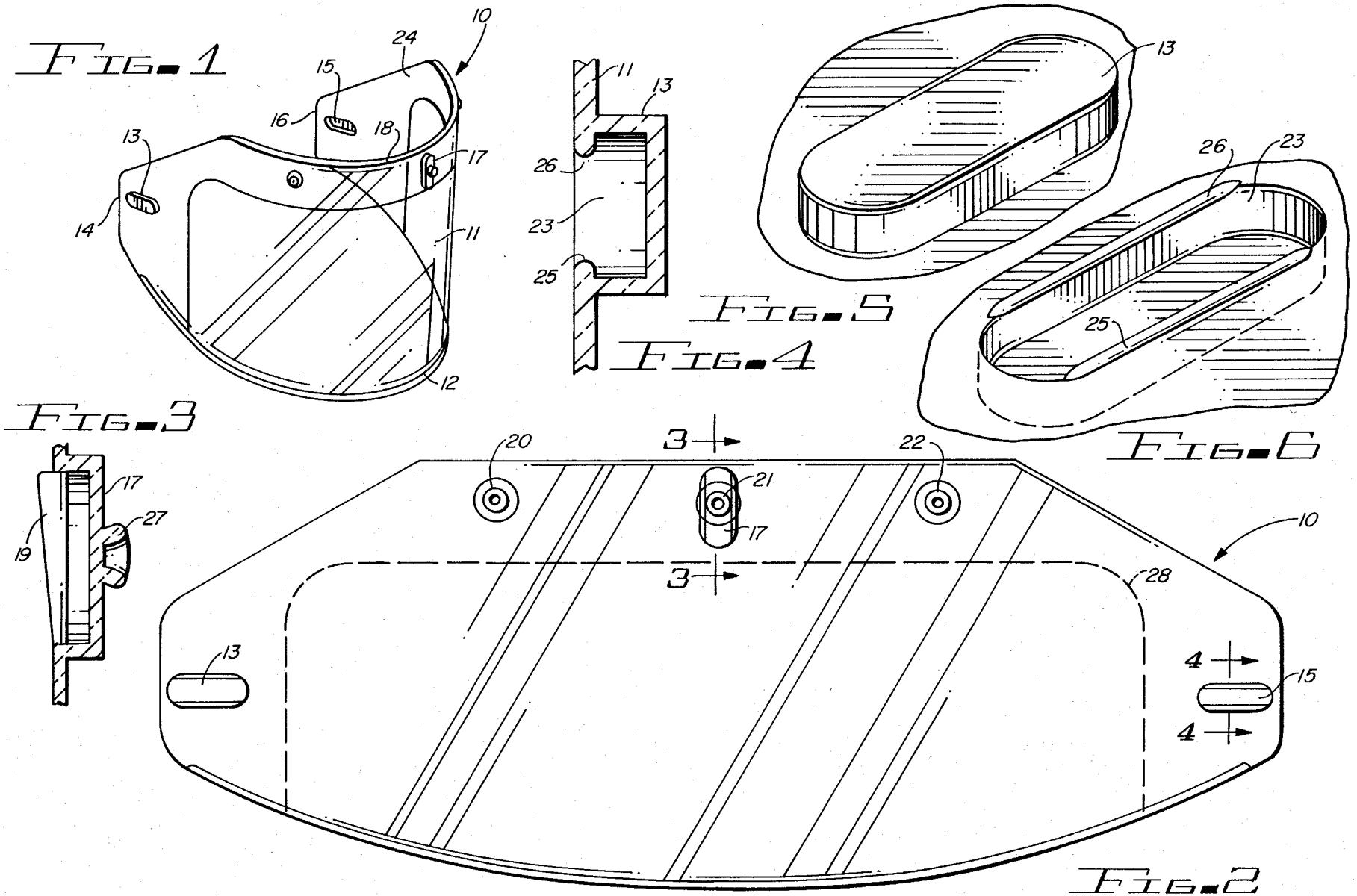
FIG. 1 is a perspective view of a shield in accordance with the present invention.
FIG. 2 is a front elevation of a flat shield in accordance with FIG. 1.
FIG. 3 is a sectional view taken on the line 3—3 of FIG. 2.
FIG. 4 is a sectional view taken on the line 4—4 of FIG. 2.
FIG. 5 is a front perspective view of an elongated snap portion in accordance with the present invention.
FIG. 6 is a back side perspective view of a snap portion in accordance with the present invention.

Referring to FIGS. 1 through 6 of the drawings, a helmet shield 10 is shown having a transparent flat portion 11 and a reinforcing edge 12 for attachment to a motorcycle helmet or the like. The shield 10 has a female snap portion 13 adjacent the edge 14 and a second female snap portion 15 on the other side of the shield 10 adjacent the edge 16. Snap portions 13 and 15 are elongated snap portions positioned in a generally horizontal position relative to a shield attached to a helmet. A center female snap portion 17 adjacent the top edge 18 is positioned in a generally vertical position. Snap portions 13, 15 and 17 are molded into the flat transparent shield 11 during the injection molding process, as are male snap portions 20, 21 and 22 formed on the face of the shield 11 for attaching a visor thereto when the shield 10 is attahced to a helmet. The elongated snap portion 13 protrudes from the front of the face 11 of the shield 10, as shown in FIGS. 4 and 5, to form an elongated groove 23 from the inside 24 of the shield 10. Elongated groove 23 has an elongated generally rounded head or lip 25 along one edge thereof and an elongated lip 26 along the other edge thereof extending over the sunken groove portion 23 to form elements of the female snap portion for which a standard male snap portion can be snapped into anywhere along the length of the groove 23. The lips 25 and 26 are rounded to allow the male snap portion to be forced therethrough and to hold the snap portion therein.

In operation, the shield is shown in FIGS. 1 and 2 is a universal shield adapted to fit a wide variety of helmets having male snap fastener portions positioned on different parts of the helmets and also to fit helmets having different shapes. An elongated female snap portion 17 has an angled or ramped lip 19 and is first snapped to the center snap of the helmet. Shield 10 can then be raised or lowered in the elongated groove to line up the horizontally extending female snap portions 13 and 15 with the outboard male snap portions on the helmet. Each outboard snap portion 13 and 15 can then be snapped onto the male portion of the helmet, which has a flexibility to line up any where over the groove's length. Thus, the shield 10 is held in a vertical and horizontal position. That is, snap portion 17 is approximately 90° from the axil alignment of the elongated snap portion 13 and 15, so that the snap portions 13 and 15 hold the shield in one direction while the vertical snap portion 17 supports it in the other directions. The angled lip 19 of snap portion 17 tilts inward slightly and assists in holding a male snap fastener portion with some helmets requiring a slight tilt to the attached shield.

Advantageously, each of the snap portions 13, 15 and 17, as well as the male snap portions 20, 21 and 22 on the front of the shield, are molded during the injection molding of the shield, making the shield economical to produce; and in the case of the female snap portion 17, the male snap portion 27 is molded directly thereon on the front side of the shield 11. A variety of polymers can be used with the invention making in possible to manufacture the snap portion of sufficient strength during an injection molding process. The elongated protruding portions of the snap fastener portion 13, 15 and 17 protruding from the front of the shield also provide an aesthetic configuration which does not detract from the overall design of the shield. This is further enhanced by a frosting around three sides of the shield, as indicated by the dash lines 28, which further blends the fastener portion into the shield without detracting from the visibility of the transparent portion of the shield.

It should be clear that other embodiments are contemplated as being within the scope of the invention, which is not to be construed as limited to the particular forms shown, which are to be considered illustrative rather than restrictive.

I claim:

1. A helmet snap on shield comprising in combination:

a transparent shield shaped to fit onto a helmet and having two sides and a top, bottom and two end edges;

a polymer center snap fastener portion formed in said shield adjacent the top edge of said shield; and a pair of side polymer snap fastener portions formed in said shield, one located adjacent each end side edge of said shield, each said side polymer snap fastener portion having an elongated groove having an elongated lip formed along each elongated edge of said groove and protruding over a portion of said groove, said elongated lips having a predetermined shape to receive a male snap fastener portion therein along said elongated groove, said pair of side polymer snap fastener portions having a back portion thereto protruding from the front of said transparent shield, whereby said helmet shield can be fitted to different helmets having male fastener portions in different positions.

2. A helmet snap on shield in accordance with claim 1, in which said pair of side polymer snap fastener portions formed in said shield are each formed with their elongated axis in a generally horizontal position when attached to a helmet.

3. A helmet snap on shield in accordance with claim 2, in which said polymer center snap fastener portion is positioned with its elongated axis in a generally vertical direction when attached to a helmet.

4. A helmet snap on shield in accordance with claim 1, in which said center snap fastener portion has its elongated axis positioned approximately 90° from the elongated axis of each of said pair of side polymer snap fastener portions.

5. A helmet snap on shield in accordance with claim 3, in which said transparent shield has a plurality of male snap fastener portions molded onto the face thereof to receive snap fastener portions on a visor, whereby a visor can be attached to said snap fastener portion on said shield when said shield is attached to a helmet.

6. A helmet snap on shield in accordance with claim 1, in which said polymer center snap fastener portion and said pair of side polymer snap portions each has a groove formed into said transparent shield and each groove has an elongated lip formed along one edge of said groove and extending over a portion of said groove.

7. A helmet snap on shield in accordance with claim 6, in which said elongated lip has a rounded shape for pressing a male snap fastener portion between said pair of lips into said groove.

8. A helmet snap on shield in accordance with claim 7, in which said transparent shield has frosting along three edge portions thereof.

9. A helmet snap on shield in accordance with claim 6, in which said polymer center snap fastener portion has the back thereof protruding from the front of said transparent shield.

10. A helmet snap on shield in accordance with claim 9, in which said polymer center snap fastener portion has a male snap fastener portion formed on the back side thereof on the front of said transparent shield.

11. A helmet snap on shield in accordance with claim 1, in which said polymer center snap fastener portion formed in said shield has an elongated groove having a pair of lips along the edges thereof, each lip being angled inward of said groove and angled from one end to the other end thereof.

* * * * *